United States Patent [19]

Braverman et al.

[11] 4,416,375

[45] Nov. 22, 1983

[54] COMPUTER PRINT FORM COVER SHEET FOR MULTI-COMPARTMENT MEDICINAL DISPENSING DEVICE

[75] Inventors: Milton Braverman; Leonard Zink, both of Philadelphia, Pa.

[73] Assignee: Medi-Dose, Inc., Feasterville, Pa.

[21] Appl. No.: 373,561

[22] Filed: Apr. 30, 1982

[51] Int. Cl.[3] ..... B65D 83/04; B65D 85/56; B65D 75/42; B65D 7/28

[52] U.S. Cl. ..... 206/534.1; 206/538; 206/484; 206/459; 206/820

[58] Field of Search ..... 206/459, 534.1, 820, 206/538

[56] References Cited

U.S. PATENT DOCUMENTS 3,715,856 2/1973 Borel ..... 206/459

3,924,748 12/1975 Braverman ..... 206/538

*Primary Examiner*—William T. Dixson, Jr.

*Attorney, Agent, or Firm*—Caesar, Rivise, Bernstein & Cohen, Ltd.

[57] ABSTRACT

A continuous feed supply of cover sheets suitable for mechanized handling by a computer driven printing means. The supply comprises an elongated web of material on which the cover sheets are releasably secured. Each of the cover sheets is divided by weakened lines corresponding to predetermined separator lines of a medicinal dispensing device base to which the cover sheet is secured to seal medicine within the base. The carrier web includes engagement portions arranged to be engaged by computer driven means to carry the individual cover sheets to a printing station for printing indicia thereon. The carrier web also includes plural die-cut areas which remain affixed to the cover sheet when the cover sheet is removed from the carrier web. The die-cut areas are arranged to overlie the medicine holding chambers of the dispensing device to protect contents therein.

9 Claims, 3 Drawing Figures

FIG. 1
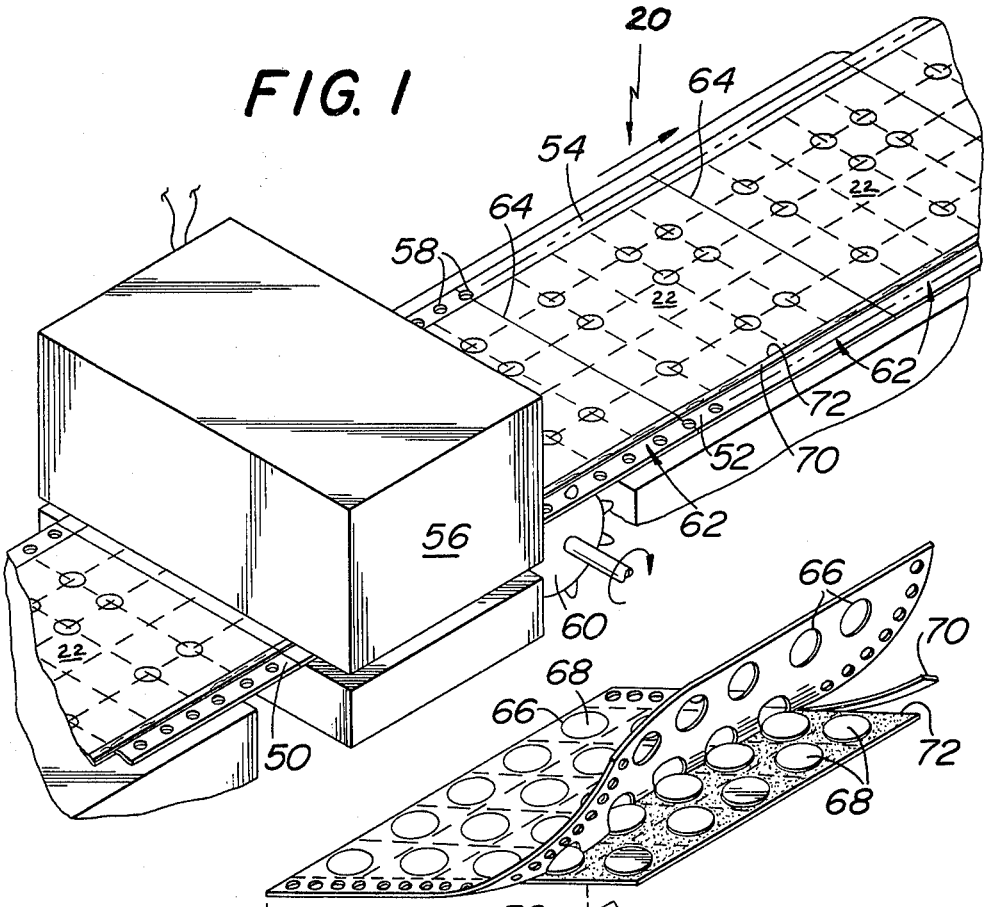
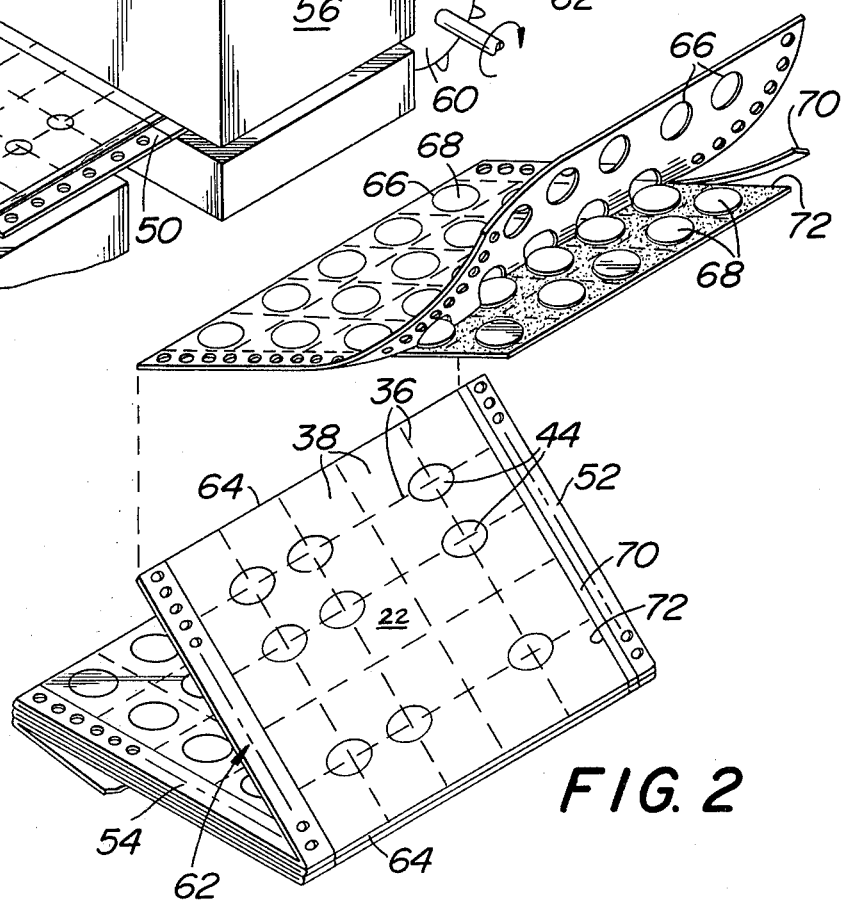
FIG. 2

COMPUTER PRINT FORM COVER SHEET FOR MULTI-COMPARTMENT MEDICINAL DISPENSING DEVICE

The present invention relates generally to medicinal dispensing devices and more particularly to closure means for multicompartment medicinal dispensing devices.

In my U.S. Pat. No. 3,780,856, whose disclosure is incorporated by reference herein, there is disclosed and claimed a medicinal dispensing device which is arranged for holding plural medicine therein for subsequent dispensation. The device is arranged to be simply loaded and labeled by a hospital or other personnel and overcomes various disadvantages of the prior art, like that disclosed in U.S. Pat. No. 3,503,493. Furthermore, unlike the prior art devices, the device of my aforenoted patent is suitable for manual unit dose use. To that end, the dispensing device as disclosed in my aforenoted patent comprises a plurality of individual medicine-holding units, each having flanges thereon. The flanges have corners and are detachably connected along certain lines so that each flange may be separate from the remaining flanges to separate the units from one another. Each unit includes a chamber with an outer opening depending from the flanges of the unit. The chamber is adapted to hold a drug, tablet, capsule or the like therein. A cover sheet covering the chamber openings serves to seal the chambers of the base by selected portions of the cover sheet contacting the flanges. The cover sheet is perforated along certain lines closely corresponding to the flange lines to form therebetween a plurality of individual closures, each of which seals the opening of the chamber in the medicine-holding unit disposed thereunder. To that end, certain portions of the interior surface of the cover sheet are provided with an adhesive coating which is in contact with the flanges, while certain other areas of the cover sheet are non-tacky and cover the chamber openings. At least one corner of a flange of each unit is removed in a cut-away area so that the existing corner of the individual closure overlying the cut-away area functions as a lift tab to facilitate the separation of that closure from the flange to which it is connected to thereby provide access to the contents of the chamber disposed thereunder.

In many applications it is desirable that the closures of the cover sheets include information such as medicine type, dosage, etc. Such information can be placed on the closures either maually, such as by hand writing, or mechanically, such as by printing etc. For large volume applications the printing of the indicia on the cover sheets is greatly preferrable to manually applying the indicia. However, due to the fact that the cover sheets of my earlier invention were individual sheets, in order to print the same at a high rate, automatic separate sheet feeding equipment must be utilized.

Accordingly, it is an object of the instant invention to overcome the disadvantages of the prior art by providing cover sheets which lend themselves to non-supervised, mechanized printing, such as can be carried out with conventional computerized printing equipment, e.g., computer controlled friction or traction feed, daisy wheel or dot matrix printers.

It is another object of the instant invention to provide a supply of cover sheets for medicinal dispensing devices which overcome the disadvantages of the prior art.

It is still a further object of the instant invention to provide a supply of cover sheets for securement to medicinal dispensing devices and which cover sheets are suitable for mechanized handling by computer driven printing means.

It is a yet further object of the instant invention to provide a supply of cover sheets for multi-compartment medicinal dispensing devices which are simple in construction and relatively low in cost.

These and other objects of the instant invention are achieved by providing a supply of cover sheets suitable for mechanized handling by computer driven printing means. Each of the cover sheets is adapted for securement to a base of a multi-compartment medicinal dispensing device to seal the device. The base comprises a plurality of individual, medicine holding units which are releasably secured together along predetermined separator lines. Each of the units includes a chamber and a flange projecting therefrom. Each of the cover sheets is divided by weakened lines corresponding to the predetermined separator lines to form individual closure members, one for each unit. The closure members each include an inner surface having an adhesive thereon. Each of the cover sheets is releasably secured by the adhesive to the carrier web at sequential longitudinal positions therealong. The carrier web includes engagement portions adapted to be engaged by computer driven means to carry the cover sheet to a printing station for applying indicia thereon. The carrier web also includes plural die-cut areas therein. Each of the areas is located under a respective closure member of a cover sheet. Each cover sheet is arranged to be removed from the carrier web, with the die-cut areas of the web remaining secured to the cover sheet to enable the cover sheet to be secured to the base, whereupon the die-cut areas overlie the chambers.

Other objects and many of the attendant advantages of this invention will become readily more apparently by reference to the accompanying drawings wherein:

FIG. 1 is a perspective view showing a continuous feed supply of cover sheets of the instant invention being transported to a printing station for the application of indicia thereon;

FIG. 2 is a perspective view of one embodiment of the supply of cover sheets.

Figure 3:
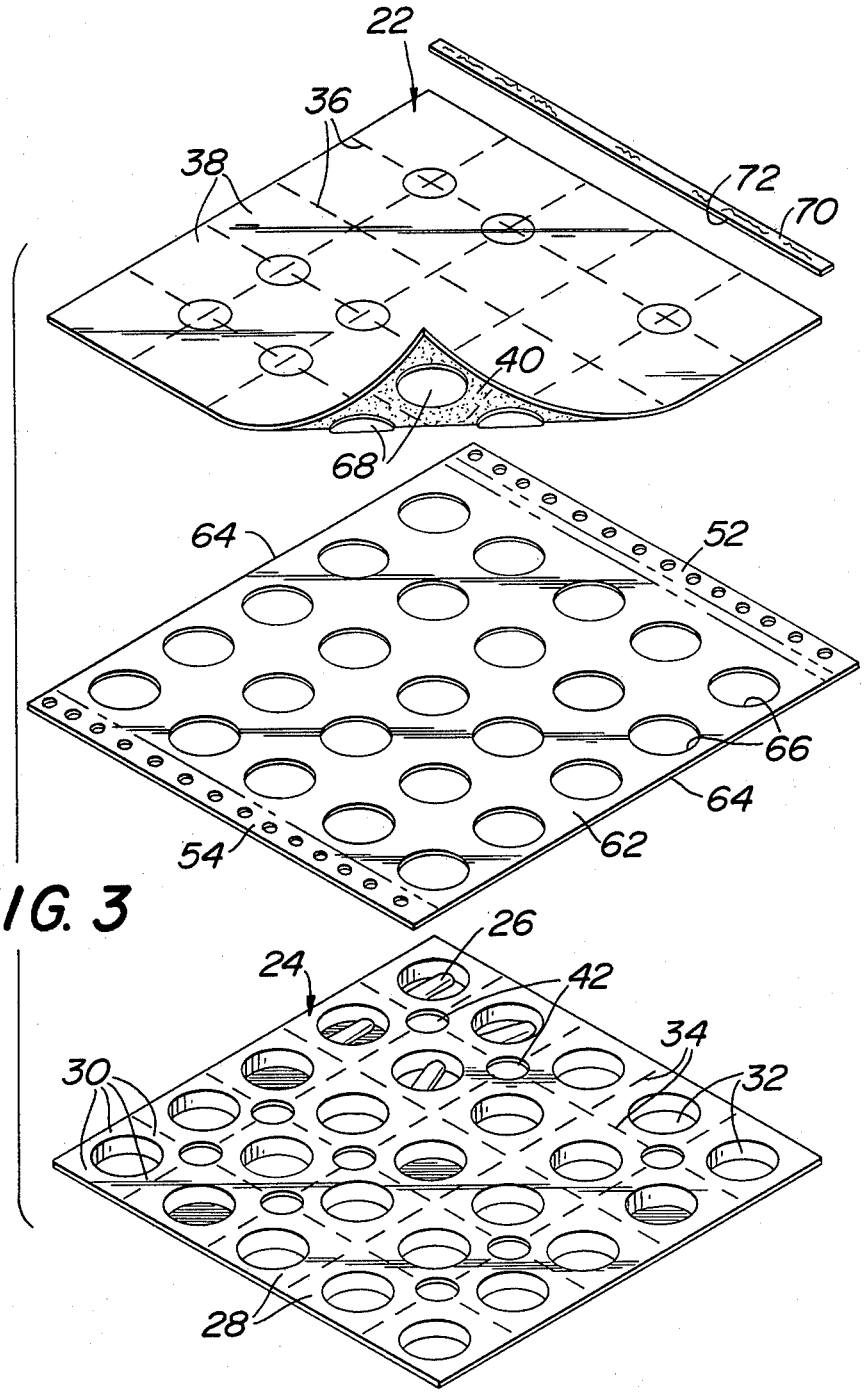
FIG. 3 is an exploded perspective view of one cover sheet of the supply of cover sheets about to be secured to the base of a multi-compartment medicinal dispensing device.

Referring now to the various figures of the drawings wherein like references characters refer to like parts there is shown generally at 20 in FIG. 1 a continuous feed supply of cover sheets 22, each arranged to form a respective closure for multi-compartment medicinal dispensing device, like that disclosed and claimed in my aforementioned U.S. patent.

As can been seen at FIG. 3 the multi-compartment medicinal dispensing device basically comprises a heretofore indentified cover sheet 22 and a multi-compartment base member 24. The base member is arranged for holding a plurality of articles, e.g. medicines 26, therein. The base 24 includes a plurality of article-holding units 28, with each unit being of square shape and comprising four flanges 30 and a bowl shaped chamber 32 depending from the flanges. The chamber is arranged to hold the medicine 26 therein.

The individual units 28 are detachably connected together by their flanges along intersecting separator lines 34. In accordance with the prefered embodiment of the invention the separator lines are weakened or perforated lines. The contents in the chamber of each unit is sealed within the chamber by a respective closure member 36.

Each closure member 36 forms a portion of the cover sheet 22. To that end the cover sheet is a planar member, which in the embodiment shown herein is of square shape, and is perforated along intersecting lines 36. The intersecting lines 36 correspond to the flange separator lines 34 in the base. The intersecting lines 36 define respective closures 36 therebetween, with each closure being coextensive in size with an associated article holding unit 28.

The cover sheet 22 is arranged to be secured to the base member 24 so that the respective closure members of the cover sheet seal respective chambers therein. To that end the underside surface of the cover sheet includes an adhesive layer 40 thereon. The adhesive can be of any type, e.g., pressure sensitive, heat activated, etc. Thus, when the cover sheet is placed on the base the adhesive layer on the underside of the cover sheet contacts the flanges to secure the cover sheet in place. When the cover sheet is so secured in place the perforated lines 36 coincide with the flanged separated lines 34 so that each closure member 36 seals the opening in the chamber of the associate article holding unit 28.

The units 28 are adapted to be readily detached from one another along the colinear lines 34 and 36 to provide individual, sealed medicine holding units.

When it is desired to remove the contents of any unit, the closure sealing that unit is peeled off to provide access to the interior of the chamber 32 and to the medicine disposed therein.

In order to facilitate the removal of a closure from its associated base unit, each base unit includes at least one cut-away flanged corner. In this regard as can be seen in FIG. 3 the base member 24 includes plural holes 42 located at contiguous corners of four adjacent units 28. Thus, at least one corner of each closure member 38 is disposed over a cut-away corner of the underlying unit's base to provide a graspable lift tab for facilitating the peeling of the closure off of the base.

The cover sheet is preferably formed of a suitable material such as a strong sturdy paper base, a plastic, such as Mylar, a metal foil, etc. Irrespective of the type of material used to form the cover sheet, the cover sheet has an exterior surface which is arranged to be receptive to pencil, ink, multilith "spirit" masters and photocopy offset. This feature enables the application of indicia on the exterior surface of the closures. Such indicia may be used to indicate the type of article or medicine contained within the chamber or may contain other information, such as instructions for use, etc.

The Application or printing of the indicia on the cover sheets by computerized printing means which constitutes a major feature of this invention, will be discribed later.

As can be seen in FIG. 1 each cover sheet includes plural dots 44 printed thereon at selected intersecting lines corresponding to the location of the holes 42 in the base. The dots indicate to the user the location of the cut-away flange corner so that the user can readily grasp the lift tab at that corner to peel the closure off the unit when that unit is separated from the others.

In order to enable the indicia to be printed on the cover sheets using a computer driven printer the supply of cover sheets 22 is in the form of continuous feed supply 20. To that end the supply 20 basically comprises a carrier in the form of a long web 50 of a material upon which the cover sheets are releasably secured. The web 50 is an elongated sheet of a relatively non-sticky material, e.g., glassine, having a pair of longitudinal marginal edges 52 and 54. The edges are arranged to be engaged by computer driven means (to be described latter) to carry the web to a printing station 56, e.g., a dot matrix or daisy wheel printer.

In the embodiment shown in FIG. 1 the web includes a plurality of equadistantly spaced apertures 58 along each marginal edge 52 and 54. The apertures are arranged to be engaged by a conventonal tractor feed mechanism 60 to carry the web past the printing station 56.

It must be pointed out at this juncture that FIG. 1 is not meant to show the exact details of the printer or the feed means therefore, since such means is conventional, but merely to represent schematically a printing station. Thus the supply of cover sheets of the instant invention can be used with any conventional traction or friction feed, computer-driven printer.

In the embodiment shown in FIG. 2 the carrier web 50 is fan-folded to form a plurality of sections 62, with each section including at least one cover sheet 22 mounted thereon. It must be pointed out at this juncture that the fan-folded embodiment of FIG. 2 is only one of several types of the supply of cover sheets of the instant invention. Thus, as will be readily appreciated the web of material with the cover sheets mounted longitudinally therealong can be in the form of a helical roll or coil. Irrespective of the type of carrier web used, it is composed of plural, sequential sections 62, with each web section mounting at least one cover sheet 22 thereon. Moreover, the interface between contiguous sections is a perforated, transverse fold line, like shown at 64, to enable respective web sections with the associate cover sheet(s) thereon to be separated from one another, thereby facilitating use.

As can seen in FIG. 2 each section 62 of the carrier web 50 includes a plurality of die-cut circular lines 66. The die-cut lines define respective circular areas 68. Each area is adapted to remain affixed to the adhesive coating 40 on the interior surface of the cover sheet after the cover sheet is peeled off the section of the carrier web as shown in FIGS. 2 and 3. Each circular portions 68 of the web section which remains affixed to cover sheet provides a non adhesive area on the interior surface of each of the closure members 38 making up that cover sheet. These non adhesive areas overlie the openings in the respective medicine holding units when the cover sheet is secured to the base member 24 so as to preclude the medicines in the units from adhering to the adhesive.

In accordance with the preferred aspect of this invention the intersecting perforated lines 36 in each cover sheet and the circular areas in the carrier web sections on which the cover sheets are temporarily mounted are die-cut from opposite sides of the cover sheet-carrier web combination. Furthermore, the perforated lines in the cover sheet are only cut through the cover sheet and not into the underlying web section. Conversely the circular cuts forming the circular areas in the web section are only cut through the web section and not into the cover sheet. This manner of forming the perforated lines in the cover sheet insures that no adhesive is carried from the interior surface of the cover sheet into the body of the carrier web section or vice versa when the die-cuts are made, which adhesive might in some cases impede the clean removal of the cover sheet from the carrier web section.

In order to expedite the grasping of the carrier web section to enable the facile removal of the cover sheet therefrom, a tab strip is provided on the web section contiguous with one edge 52 thereof. In this connection as can be seen in FIG. 1 the tab strip comprises an elonged strip 70 which extends the length of each cover sheet and is die-cut along line 72 close to and parallel with the edge 52 of the carrier web section. The die-cut line 72 extends through the cover sheet not into the carrier web section. This line serves as a bend line to enable the separation of the cover sheet from the web section. To that end the strip 70 is grasped between the fingers of one's hand and bent along line 72 toward the carrier web. This action has the effect of delaminating the cover sheet from the carrier web section along portions of the cover sheet continguous with line 72. The tab 70 is then pulled away from the cover sheet to effect the complete removal or peeling of the web section from the cover sheet as shown in FIG. 3.

The printing of desired information or instructions on the cover sheets of the supply 20 and their subsequent use is as follows:

Sequentially mounted cover sheets 22 on either a fan folded (FIG. 2) or coiled (not shown) supply 20 are fed, via means 60, to a computerized printer 56. Each cover sheet is already preprinted with the dots 44, denoting the lift tab areas, and any other information such as trademarks, etc., thereon. As each cover sheet reaches the printer the desired custom information, e.g., medicine type, dosage, etc., is printed on the cover sheet's closures as directed by a computer means (not shown) controlling the printer. Once the complete supply 20 has been printed and fan folded or rolled up (as the case may be) it is now ready for use.

To use the cover sheet, it and its associated web section is removed from the supply 20 by tearing the section along line 64. The cover sheet is thereafter removed from the associated section, as described heretofore and is now ready for securement to a filled base member 24 to complete the medicinal dispensing device. It must be pointed out that use of the cover sheet doesn't require the separation of the web section mounting that cover sheet from the remaining sections of the supply. Thus, each cover sheet to be used can merely be peeled off its associated web section while that section remains secured to the supply.

As should be appreciated from the foregoing the supply of cover sheets of the instant invention provides a viable and effective means for automated printing of the cover sheets with any desired indicia. Moreover, the carrier web used to transport the individual cover sheets to the computer-driven printer also serves as means for protecting the contents of the interior of the completed medicinal dispensing device from contact with the adhesive of the cover sheet.

Without further elaboration the foregoing will so fully illustrate my invention then others, made by applying current or future knowledge, readily adapt the same for use on various conditions of service.

We claim:

1. A supply of cover sheets suitable for mechanized handling of computer driven printing means, each of said cover sheets being adapted for securement to a base of a multicompartment medicinal dispensing device to seal said device, said base comprising a plurality of individual medicine holding units releasably secured together along predetermined separator lines, each of said units including a chamber and a flange, each of said cover sheets being divided by weakened lines corresponding to said predetermined separator lines to form individual closure members, one for each unit, said closure members having an inner surface having an adhesive thereon, each of said cover sheets being releasably secured by said adhesive at sequential longitudinal positions along a carrier web, said carrier web having engagement portions in the form of respective marginal edge portions including plural apertures therein arranged to be engaged by computer driven means to carry said cover sheets to a printing station for applying indicia thereon, said carrier web also including plural die cut areas, each of said areas being located under a respective closure member, each of said cover sheets covering said web except the portion including the plural apertured portion of said respective marginal edge portions, said cover sheets being arranged to be removed from said carrier web with said die cut areas of said web remaining secured to said cover sheet to enable said cover sheet to be secured to said base via said flanges whereupon said die cut areas overlie said chambers.

2. The supply of cover sheets of claim 1 wherein said web is fan folded into plural sections, with each section including at least one cover sheet thereon.

3. The supply of cover sheets of claim 1 wherein said web is rolled up.

4. The supply of cover sheets of claim 2 wherein said web is formed of a relatively non-sticky material.

5. The supply of cover sheets of claim 4 wherein said material comprises glassine.

6. The supply of cover sheets of claim 1 wherein each of said cover sheets is formed of paper.

7. The supply of cover sheets of claim 1 wherein each of said cover sheets is formed of Mylar.

8. The supply of cover sheets of claim 1 wherein each of said cover sheets is formed of a metal foil.

9. The supply of cover sheets of claim 1 wherein said weakened lines and said separator lines are perforated lines and wherein said die cut areas are circular areas.

* * * * *